US010518951B2

(12) United States Patent
Holley, Jr.

(10) Patent No.: US 10,518,951 B2
(45) Date of Patent: Dec. 31, 2019

(54) CARTON FOR CONTAINERS

(71) Applicant: Graphic Packaging International, Inc, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 626 days.

(21) Appl. No.: 14/973,983

(22) Filed: Dec. 18, 2015

(65) Prior Publication Data

US 2016/0176594 A1 Jun. 23, 2016

Related U.S. Application Data

(60) Provisional application No. 62/124,599, filed on Dec. 23, 2014.

(51) Int. Cl.
*B65D 71/58* (2006.01)

(52) U.S. Cl.
CPC .. *B65D 71/0022* (2013.01); *B65D 2571/0066* (2013.01); *B65D 2571/00388* (2013.01); *B65D 2571/00444* (2013.01)

(58) Field of Classification Search
CPC ..... B65D 71/0022; B65D 2571/00141
See application file for complete search history.

(56) References Cited

U.S. PATENT DOCUMENTS

| | | | |
|---|---|---|---|
| 2,222,211 | A | 11/1940 | Arneson |
| 2,225,822 | A | 12/1940 | Crook |
| 2,227,330 | A | 12/1940 | Turner |
| 2,331,312 | A | 10/1943 | Dorfman |
| 2,336,857 | A | 12/1943 | Gies et al. |
| 2,457,308 | A | 12/1948 | Hall et al. |
| 2,458,281 | A | 1/1949 | Lupton |
| 2,460,108 | A | 1/1949 | Smith et al. |
| 2,525,686 | A | 10/1950 | Kowal |
| 2,535,741 | A | 12/1950 | Lighter |
| 2,537,615 | A | 1/1951 | Arneson |
| 2,660,361 | A | 11/1953 | Tyrseck |
| 2,689,061 | A | 9/1954 | Gray |

(Continued)

FOREIGN PATENT DOCUMENTS

| | | |
|---|---|---|
| DE | 9004439 | 6/1990 |
| EP | 1 319 607 | 6/2003 |

(Continued)

OTHER PUBLICATIONS

International Search Report and Written Opinion for PCT/US2015/066591 dated Apr. 12, 2016.

*Primary Examiner* — Steven A. Reynolds
*Assistant Examiner* — Javier A Pagan
(74) *Attorney, Agent, or Firm* — Womble Bond Dickinson (US) LLP

(57) ABSTRACT

A carrier for holding a plurality of containers. The carrier comprises a plurality of panels extending at least partially around an interior of the carrier. The plurality of panels can comprise at least a front panel and a side panel. A central panel can at least partially divide the interior of the carrier into a front portion and a back portion, and the side panel can extend at least partially between the front panel and the central panel. A handle can comprise a handle feature extending in at least the side panel.

46 Claims, 8 Drawing Sheets

(56) References Cited

U.S. PATENT DOCUMENTS 2,721,001 A 10/1955 Hasselhoff
2,772,020 A 11/1956 Kramer
2,776,072 A 1/1957 Forrer
2,783,916 A 3/1957 Hodapp
2,887,245 A 5/1959 Levkoff
2,977,021 A 3/1961 Shiels, Jr.
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,373,917 A 3/1968 Cox
3,432,073 A 3/1969 Forrer
3,554,401 A 1/1971 Wood
3,572,544 A 3/1971 Forrer
3,579,653 A 5/1971 Kuhn
3,624,790 A 11/1971 Stout
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,754,680 A 8/1973 Wood
3,384,053 A 1/1974 Stout
3,794,210 A 2/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,293,091 A * 10/1981 Gerard ..... B65D 5/48014 229/117.16
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A * 11/1984 Wood ..... B65D 71/0022 206/141
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,852,731 A 8/1989 Cooper
4,927,009 A 5/1990 Stout
4,972,944 A 11/1990 McNeill
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,221,001 A 6/1993 Eisman
5,234,103 A 8/1993 Schuster
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,579,904 A 12/1996 Holley, Jr.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
D394,205 S 5/1998 Bates
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Haft et al.
5,947,273 A 9/1999 Dalrymple et al.
5,979,645 A 11/1999 Holley
6,003,665 A 12/1999 Stout
6,041,920 A 3/2000 Hart et al.
6,102,197 A 8/2000 Negelen
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,321,906 B1 11/2001 Wein
6,341,689 B1 1/2002 Jones
6,371,287 B1 4/2002 Jones et al.
6,571,941 B2 6/2003 Holley, Jr.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,134,547 B2 11/2006 Aclair
7,207,934 B2 4/2007 Schuster
7,374,038 B2 5/2008 Smalley
7,448,492 B2 11/2008 Sutherland

(56) References Cited

U.S. PATENT DOCUMENTS

| | | | |
|---|---|---|---|
| 7,472,791 | B2 | 1/2009 | Spivey, Sr. |
| 7,552,820 | B2 | 6/2009 | Kohler |
| 7,578,385 | B2 | 8/2009 | Holley |
| 7,604,116 | B2 | 10/2009 | Schuster |
| 7,644,817 | B2 | 1/2010 | Sutherland |
| 7,677,387 | B2 | 3/2010 | Brand et al. |
| 7,753,195 | B2 | 7/2010 | Cuomo |
| 7,762,395 | B2 | 7/2010 | Sutherland et al. |
| 7,762,397 | B2 | 7/2010 | Coltri-Johnson et al. |
| 7,793,780 | B2 | 9/2010 | Smalley |
| 8,020,695 | B2 | 9/2011 | Brand |
| 8,297,437 | B2 | 10/2012 | Smalley et al. |
| 8,453,832 | B2 | 6/2013 | Skolik et al. |
| 8,770,397 | B2 | 7/2014 | Holley, Jr. |
| 9,061,810 | B2 | 6/2015 | Brand |
| 2002/0077236 | A1 | 6/2002 | Chalendar et al. |
| 2002/0117407 | A1 | 8/2002 | Holley |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0026269 | A1 | 2/2004 | Cuomo |
| 2004/0050722 | A1 | 3/2004 | Schuster |
| 2004/0094435 | A1 | 5/2004 | Auclair et al. |
| 2004/0104134 | A1 | 6/2004 | Skolik et al. |
| 2005/0211577 | A1 | 9/2005 | Bakx |
| 2005/0218014 | A1 | 10/2005 | Schuster |
| 2005/0230273 | A1 | 10/2005 | Kohler |
| 2006/0091024 | A1 | 5/2006 | Cuomo |
| 2006/0148629 | A1 | 7/2006 | Cuomo |
| 2006/0157545 | A1 | 7/2006 | Auclair |
| 2006/0231440 | A1 | 10/2006 | Holley, Jr. |
| 2007/0000980 | A1 | 1/2007 | Oliveira |
| 2007/0017839 | A1 | 1/2007 | Sutherland |
| 2007/0029211 | A1 | 2/2007 | Cuomo |
| 2007/0029212 | A1 | 2/2007 | Smalley |
| 2007/0151873 | A1 | 7/2007 | Schuster |
| 2008/0041735 | A1 | 2/2008 | Cuomo |
| 2008/0210581 | A1 | 9/2008 | Brand |
| 2009/0008273 | A1 | 1/2009 | Smalley |
| 2010/0006458 | A1 | 1/2010 | Wilkins et al. |
| 2010/0072086 | A1 | 3/2010 | Smalley |
| 2010/0320098 | A1 | 12/2010 | Brand |
| 2011/0127318 | A1 | 6/2011 | Philips |
| 2015/0321816 | A1 | 11/2015 | Holley |

FOREIGN PATENT DOCUMENTS

| | | |
|---|---|---|
| EP | 1 852 359 | 11/2007 |
| EP | 2 102 073 | 9/2010 |
| FR | 2 825 074 | 11/2002 |
| GB | 926874 | 5/1963 |
| WO | WO 97/05026 | 2/1997 |
| WO | WO 99/01356 | 1/1999 |
| WO | WO 2006/020525 | 2/2006 |
| WO | WO 2006/113824 | 10/2006 |
| WO | WO 2008/089124 | 7/2008 |

* cited by examiner

CARTON FOR CONTAINERS

CROSS-REFERENCE TO RELATED APPLICATIONS

This application claims the benefit of U.S. Provisional Patent Application No. 62/124,599, filed on Dec. 23, 2014.

INCORPORATION BY REFERENCE

The disclosure of U.S. Provisional Patent Application No. 62/124,599, which was filed on Dec. 23, 2014, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier comprises a plurality of panels extending at least partially around an interior of the carrier. The plurality of panels can comprise at least a front panel and a side panel. A central panel can at least partially divide the interior of the carrier into a front portion and a back portion, and the side panel can extend at least partially between the front panel and the central panel. A handle can comprise a handle feature extending in at least the side panel.

In another aspect, the disclosure is generally directed to a blank for forming a carrier for holding a plurality of containers. The blank comprises a plurality of panels comprising at least a front panel and a side panel. A central panel can be for at least partially dividing the carrier formed from the blank into a front portion and a back portion. The side panel can be for extending at least partially between the front panel and the central panel when the carrier is formed from the blank. A handle can comprise a handle feature extending in at least the side panel.

In another aspect, the disclosure is generally directed to a method of forming a carrier for containing a plurality of containers. The method comprises obtaining a blank comprising a plurality of panels, a central panel, and a handle feature. The plurality of panels can comprise at least a front panel and a side panel. The handle feature can extend in at least the side panel. The method further can comprise forming an interior of the carrier by positioning the panels of the plurality of panels to extend at least partially around the interior of the carrier and positioning the central panel to at least partially divide the interior of the carrier into a front portion and a back portion. The side panel can extend at least partially between the front panel and the central panel. The handle feature can at least partially form a handle in the carrier.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass and/or aluminum bottles or plastic containers) at least partially disposed within the carrier embodiments. In this specification, the terms "inner," "interior," "outer," "exterior," "lower," "bottom," "upper," "top," "front," "forward," "back," and "rearward" indicate orientations determined in relation to fully erected carriers.

Figure 1:
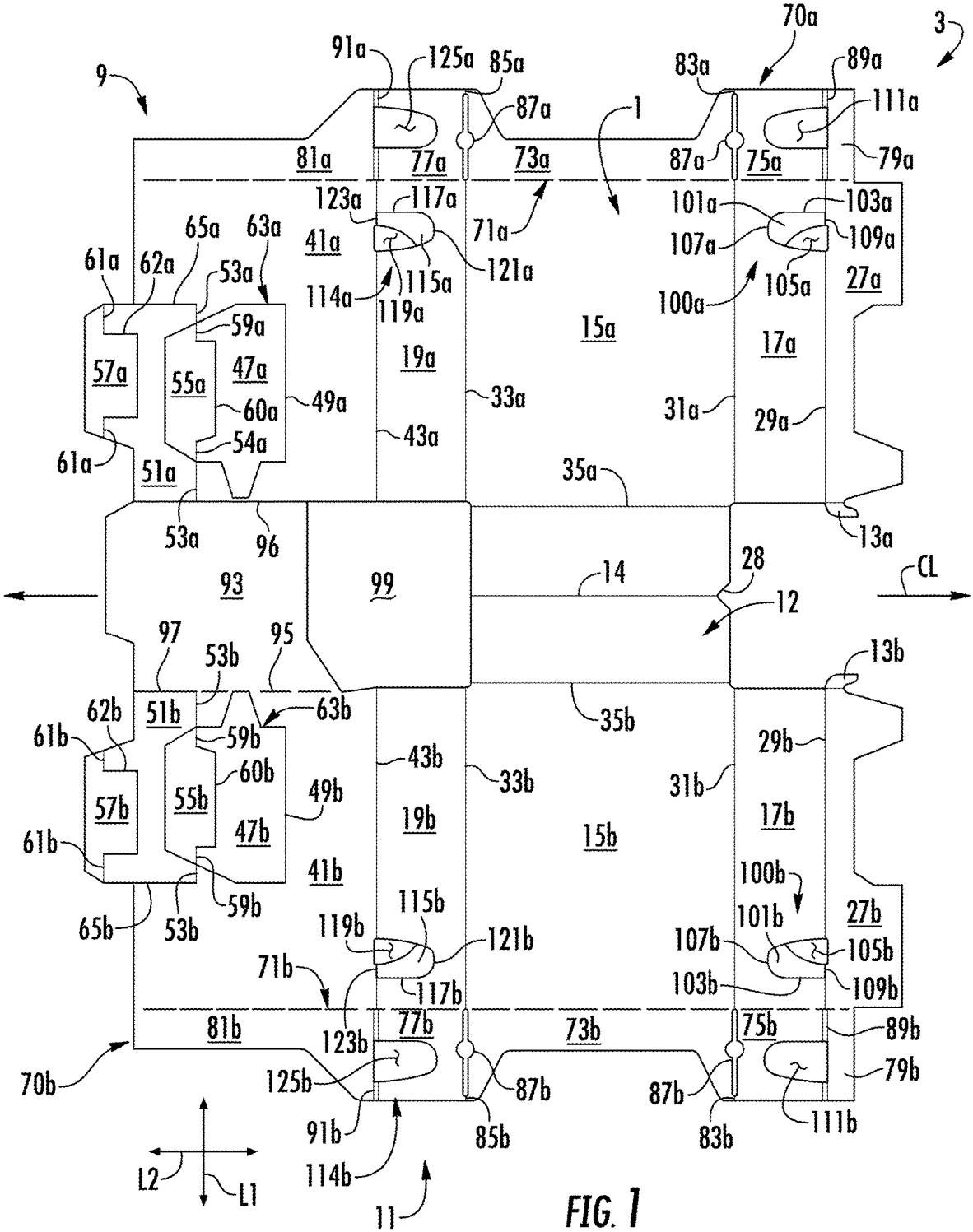
FIG. 1 is an exterior plan view of a blank used to form a carrier according to an exemplary embodiment of the disclosure.

FIG. 1 is a plan view of an exterior side 1 of the blank 3 used to form a package or basket-style carrier 5 (FIGS. 6-8), in accordance with an exemplary embodiment of the present disclosure. As shown in FIG. 8, the carrier 5 is sized to contain six containers C, three containers being contained in a front portion 9 of the carrier and three containers being contained in a back portion 11 of the carrier. The carrier can be sized and shaped to hold containers of a different or same quantity in more than one layer and/or in different row/column arrangements (e.g., 1×6, 3×4, 2×6×2, 3×5, 4×5, 2×9, 2×6, 4×4, etc.). In the illustrated embodiment, the carrier 5 includes handles 7, 8 (FIGS. 8-10). As will be discussed below in more detail, the handles 7, 8, are formed from various features in the blank 3.

The carrier blank 3 has a longitudinal axis L1 and a lateral or transverse axis L2. The carrier blank 3 has a front portion 9, a back portion 11, a bottom panel 12 foldably connected to the front portion and the back portion. In the illustrated embodiment, the front portion 9 and back portion 11 are for being folded about a lateral centerline CL (FIG. 1) when the carrier blank 3 is formed into the carrier 5. In one embodiment, a lateral intermediate fold line 14 in the bottom panel 12 can extend along the centerline CL. As discussed in more detail below, the carrier blank 3 is formed into the carrier 5 by folding the carrier blank about the centerline CL (e.g., the intermediate fold line 14) so that the front portion 9 and the back portion 11 are generally overlapped.

In the illustrated embodiment, the front portion 9, comprises a front panel 15*a* foldably connected to a first side panel 17*a* and a second side panel 19*a*. A front central flap 27*a* is foldably connected to the first side panel 17*a* at a longitudinal fold line 29*a*. Longitudinal fold lines 31*a*, 33*a* foldably connect the respective first and second side panel 17*a*, 19*a* to the front panel 15*a*. A lateral fold line 35*a* connects the bottom panel 12 to the front panel 15*a*.

As shown in FIG. 1, the front portion 9 includes a front central panel 41*a* foldably connected to the second side panel 19*a* at a longitudinal fold line 43*a*. A first divider flap 47*a* is foldably connected to the front central panel 41*a* along a longitudinal fold line 49*a*. A second divider flap 51*a* is foldably connected to the front central panel 41*a* at two longitudinal fold lines 53*a* that are spaced apart by a portion of the first divider flap 47*a*. Each of the divider flaps 47*a*, 51*a* includes a respective attachment flap 55*a*, 57*a*. The attachment flaps 55*a*, 57*a* are foldably connected to the respective divider flaps 47*a*, 51*a* at respective longitudinal fold lines 59*a*, 61*a*. A generally U-shaped cut 60*a* extends between the fold lines 59*a*, and a generally U-shaped cut 62*a* extends between the fold lines 61*a*. The first divider flap 47*a* and the attachment flap 55*a* are at least partially defined by a tear or cut line 63*a*, the cut 60*a*, and the fold lines 49*a*, 59*a*. The second divider flap 51*a* is at least partially defined by the cut line 63*a*, the cut 62*a*, the fold lines 53*a*, 61*a*, and a tear or cut line 65*a* that extends from a longitudinal edge of the blank 3 to the fold lines 53*a*. The central panel 41*a*, any of the divider flaps 47*a*, 51*a*, and/or any of the attachment flaps 55*a*, 57*a* could be omitted or could be otherwise shaped, arranged, positioned, and/or configured without departing from the disclosure.

As shown in FIG. 1, the front portion 9 can include a front reinforcing structure 70*a* foldably connected to the front panel 15*a*, the front side panels 17*a*, 19*a*, the front central flap 27*a*, and the front central panel 41*a* along a lateral fold line 71*a*. The front reinforcing structure 70*a* can include a front reinforcing panel 73*a*, side reinforcing panels 75*a*, 77*a*, and central reinforcing panels 79*a*, 81*a*. The front reinforcing panel 73*a* can be foldably connected to the side reinforcing panels 75*a*, 77*a* along respective longitudinal fold lines 83*a*, 85*a* and separated from the side reinforcing panels 75*a*, 77*a*, along respective slots or openings 87*a*. The side reinforcing panels 75*a*, 77*a* are foldably connected to the respective central reinforcing panels 79*a*, 81*a* along respective fold lines or fold areas 89*a*, 91*a*. In the illustrated embodiment, the fold areas 89*a*, 91*a* each can include two spaced, parallel fold lines (which can be interrupted by respective handle features as described in more detail below). As shown in FIG. 1, the front reinforcing panel 73*a*, the side reinforcing panels 75*a*, 77*a*, and the central reinforcing panels 79*a*, 81*a* are foldably connected to the respective front panel 15*a*, side panels 17*a*, 19*a*, front central flap 27*a*, and front central panel 41*a* along the lateral fold line 71*a*. In one embodiment, the slots 87*a* and/or the fold areas 89*a*, 91*a* can help with folding of the panels when forming the carrier 5 while the reinforcing panels 73*a*, 75*a*, 77*a*, 79*a*, 81*a* overlap the respective front panel 15*a*, side panels 17*a*, 19*a*, central flap 27*a*, and central panel 41*a* and the fold lines 83*a*, 85*a* and fold areas 89*a*, 91*a* overlap the respective fold lines 31*a*, 33*a*, 29*a*, 43*a*. The front reinforcing structure 70*a* could be omitted or could be otherwise shaped, arranged, positioned, and/or configured without departing from the disclosure.

In the illustrated embodiment, the features of the back portion 11 of the blank 3 include a back panel 15*b*, a first side panel 17*b*, and a second side panel 19*b*, that are generally a mirror-image of the corresponding panel or flap of the front portion 9. A back central flap 27*b* is also similarly configured to (e.g., generally a mirror image of) the front central flap 27*a*, and a back central panel 41*b* is similarly configured to (e.g., generally a mirror image of) the front central panel 41*a*. Additionally, back divider flaps 47*b*, 51*b* and attachment flaps 55*b*, 57*b* are similarly configured to (e.g., generally a mirror image of) the front divider flaps 47*a*, 51*a* and attachment flaps 55*a*, 57*a*. Further, a back reinforcing structure 70*b*, including reinforcing panels 73*b*, 75*b*, 77*b*, 79*b*, 81*b*, is similarly configured to (e.g., generally a mirror image of) the front reinforcing structure 70*a*, including respective reinforcing panels 73*a*, 75*a*, 77*a*, 79*a*, 81*a*. Alternatively, one or more of the features of the back portion 11 could be different than the respective feature(s) of the front portion 9. Corresponding components (e.g., panels, flaps, fold lines, cuts, etc.) have been designated by corresponding reference numbers that differ by the "a" or "b" suffix, with the "a" components corresponding to the front portion 9 and the "b" components corresponding to the back portion 11 of the blank 3.

As shown in FIG. 1, the front panel 15*a* is foldably connected to the bottom panel 12 along the lateral fold line 35*a*, and the back panel 15*b* is foldably connected to the bottom panel 12 along a lateral fold line 35*b*. An intermediate panel 93 can be foldably connected to the back central panel 41*b* along a fold line 95 and can be separable from the front central panel 41*a* and the divider flap 51*a* along a cut or tear line 96. Alternatively, the intermediate panel 93 could be spaced from the front central panel 41*a* by a cutout or opening, for example. In the illustrated embodiment, the intermediate panel is separable from the divider flap 51*b* along a tear or cut line 97. The front portion 9 is generally spaced from the back portion by the bottom panel 12, and a cutout or opening 99 can be formed between the front central panel 41*a*, the front side panel 19*a*, the bottom panel 12, the intermediate panel 93, the back central panel 41*b*, and the back side panel 19*b*. The blank 3 could be otherwise shaped, arranged, positioned, and/or configured without departing from the disclosure.

In the illustrated embodiment, the features that form the handles 7, 8 can include handle features formed in the front side panels 17*a*, 19*a*, back side panels 17*b*, 19*b*, and side reinforcing panels 75*a*, 77*a*, 75*b*, 77*b*. As shown in FIG. 1, features 100*a* for forming the handle 7 can include a first handle flap 101*a* foldably connected to the first side panel 17*a* along a lateral fold line 103*a* adjacent an opening 105*a*. The first handle flap 101*a* can be separable from the first side panel 17*a* along a curved tear or cut line 107*a* and can be separable from the front central flap 27*a* along a longitudinal tear or cut line 109*a*. As shown in FIG. 1, the opening 105*a* can interrupt the fold line 29*a* and can extend along an edge of the central flap 27*a* and/or can extend into the central flap 27*a*. In the illustrated embodiment, a handle opening 111*a* can be formed in the side reinforcing panel 75*a* adjacent the central reinforcing panel 79*a* so that the opening 111*a* interrupts the fold area 89*a*. As shown in FIG. 1, features 100*b* for forming the handle 7 can include a corresponding second handle flap 101*b* foldably connected to the first side panel 17*b* along a lateral fold line 103*b* adjacent an opening

105*b*. The second handle flap 101*b* can be separable from the first side panel 17*b* along a curved tear or cut line 107*b* and can be separable from the back central flap 27*b* along a longitudinal tear or cut line 109*b*. As shown in FIG. 1, the opening 105*b* can interrupt the fold line 29*b* and can extend along an edge of the central flap 27*b* and/or can extend into the central flap 27*b*. A handle opening 111*b* can be formed in the side reinforcing panel 75*b* adjacent the central reinforcing panel 79*b* so that the opening 111*b* interrupts the fold area 89*b*. In one embodiment, the handle features 100*b* generally can be similarly configured to (e.g., generally a mirror image of) the handle features 100*a*. Any of the handle features 100*a*, 100*b* could be omitted or could be otherwise shaped, arranged, positioned, and/or configured without departing from the disclosure. For example, the handle 7 could include one or more handle flaps could be foldably connected to one or both of the side reinforcing panels 75*a*, 75*b* alternatively or in addition to the handle flaps 101*a*, 101*b*.

Similarly, in the illustrated embodiment, handle features 114*a* for forming the handle 8 can include a first handle flap 115*a* foldably connected to the second side panel 19*a* along a lateral fold line 117*a* adjacent an opening 119*a*. The first handle flap 115*a* can be separable from the second side panel 19*a* along a curved tear or cut line 121*a* and from the front central panel 41*a* along a longitudinal tear or cut line 123*a*. As shown in FIG. 1, the opening 119*a* can interrupt the fold line 43*a* and can extend along an edge of the central panel 41*a* and/or can extend into the central panel 41*a*. In the illustrated embodiment, a handle opening 125*a* can be formed in the side reinforcing panel 77*a* adjacent the central reinforcing panel 81*a* so that the opening 125*a* interrupts the fold area 91*a*. As shown in FIG. 1, features 114*b* for forming the handle 8 can include a corresponding second handle flap 115*b* foldably connected to the second side panel 19*b* along a lateral fold line 117*b* adjacent an opening 119*b*. The second handle flap 115*b* can be separable from the second side panel 19*b* along a curved tear or cut line 121*b* and from the back central panel 41*b* along a longitudinal tear or cut line 123*b*. As shown in FIG. 1, the opening 119*b* can interrupt the fold line 43*b* and can extend along an edge of the central panel 41*b* and/or can extend into the central panel 41*b*. A handle opening 125*b* can be formed in the side reinforcing panel 77*b* adjacent the central reinforcing panel 81*b* so that the opening 125*b* interrupts the fold area 91*b*. In one embodiment, the handle features 114*b* generally can be similarly configured to (e.g., generally a mirror image of) the handle features 114*a*. Any of the handle features 114*a*, 114*b* could be omitted or could be otherwise shaped, arranged, positioned, and/or configured without departing from the disclosure. For example, the handle 8 could include one or more handle flaps could be foldably connected to one or both of the side reinforcing panels 77*a*, 77*b* alternatively or in addition to the handle flaps 115*a*, 115*b*.

As shown in FIG. 1, in the front reinforcing structure 70*a*, the front reinforcing panel 73*a* and the central reinforcing panel 81*a* have portions that are narrower than the side reinforcing panels 75*a*, 77*a* and the central reinforcing panel 79*a* (e.g., in the longitudinal direction L1). The front reinforcing panel 73*a* and the central reinforcing panel 81*a* can be tapered adjacent to the wider side reinforcing panels 75*a*, 77*a* and central reinforcing panel 79*a*. Accordingly, the front reinforcing structure 70*a* can extend around the handle features 100*a*, 114*a* while the narrower front reinforcing panel 73*a* and central reinforcing panel 81*a* can help reduce the amount of blank material needed. The back reinforcing structure 70*b* is similarly configured in the illustrated embodiment. In an alternative embodiment, the front reinforcing structure 70*a* and/or the back reinforcing structure 70*b* could have a consistent width (e.g., the longitudinal distance between the fold line 71*a*, 71*b* and the respective edge of the respective reinforcing structure 70*a*, 70*b*). For example, the front reinforcing panel 73*a* and the central reinforcing panel 81*a* could be widened to correspond to the side reinforcing panels 75*a*, 77*a* and the central reinforcing panel 79*a*. Alternatively, the side reinforcing panels 75*a*, 77*a* and the central reinforcing panel 79*a* could be narrowed to correspond to the front reinforcing panel 73*a* and the central reinforcing panel 81*a*, in which case the openings 111*a*, 125*a* would be replaced by cutouts that define portions of the edges of the respective side reinforcing panels 75*a*, 77*a*.

Any of the panels, flaps, fold lines, cuts, or other features could be omitted or could be otherwise shaped, arranged, positioned, and/or configured in the blank 3 without departing from the disclosure. The blank 3 could be sized and/or shaped to accommodate more or less than six containers C without departing from this disclosure.

Figure 2:
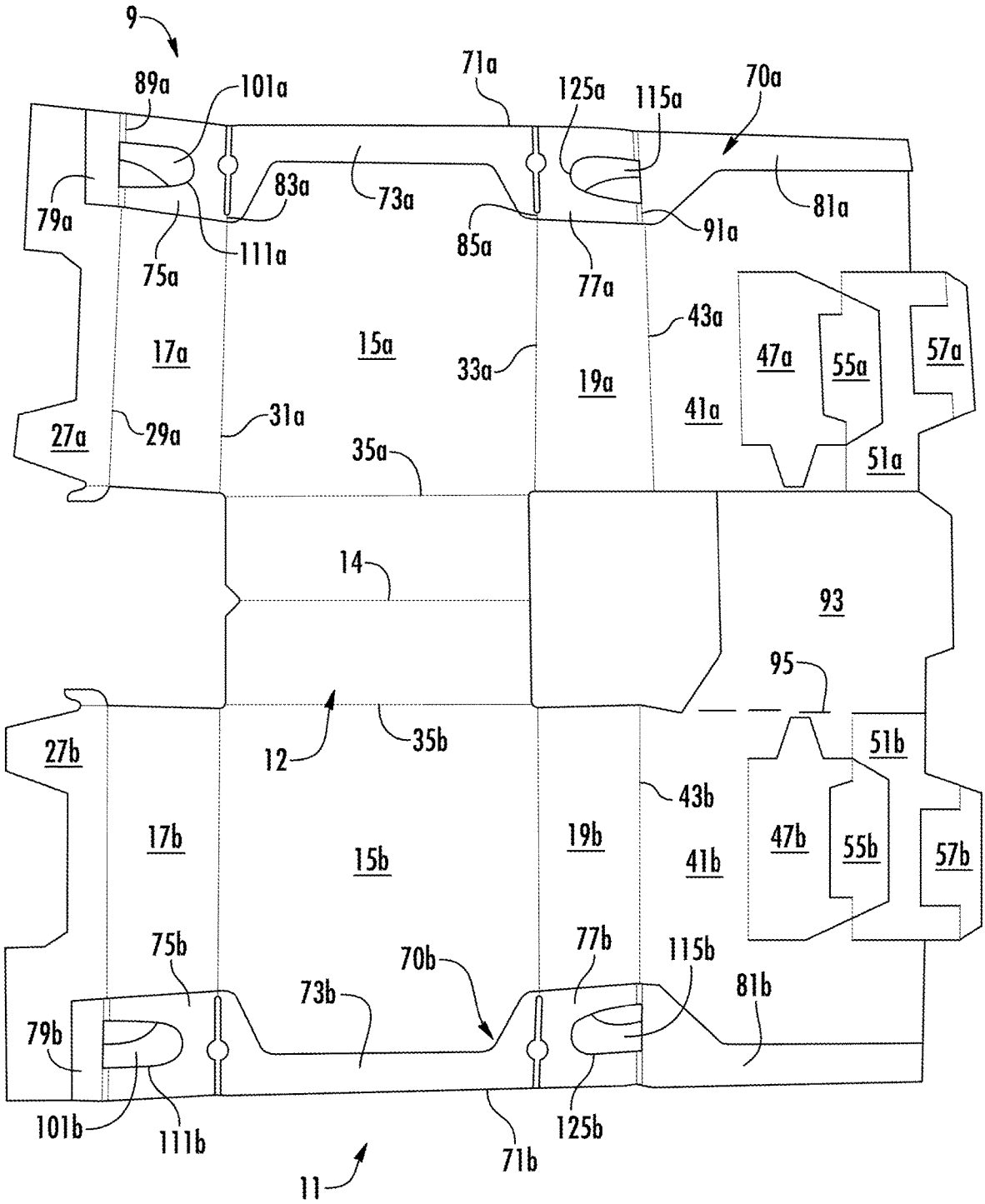
FIGS. 2-4 are views showing folding of the blank of FIG. 1 to form the carrier according to the exemplary embodiment of the disclosure.

With reference to FIGS. 2-5, in one exemplary method of erection, the carrier 5 can be erected from the blank 3 by positioning the panels 15*a*, 15*b*, 17*a*, 17*b*, 19*a*, 19*b*, the central flaps 27*a*, 27*b*, the central panels 41*a*, 41*b*, the reinforcing structures 70*a*, 70*b*, and the dividers 47, 51, 87, 91 relative to each other to form the front portion 9 and the back portion 11 of the carrier 5. Particularly, FIG. 2 generally shows an interior surface 2 of the blank 3 after exemplary first folds of the blank, including folding the reinforcing structures 70*a*, 70*b* along the respective lateral fold lines 71*a*, 71*b*. Accordingly, the front reinforcing panels 73*a*, 75*a*, 77*a*, 79*a*, 81*a* generally overlap the respective front panel 15*a*, side panels 17*a*, 19*a*, front central flap 27*a*, and front central panel 41*a*. Similarly, the back reinforcing panels 73*b*, 75*b*, 77*b*, 79*b*, 81*b* generally overlap the respective back panel 15*b*, side panels 17*b*, 19*b*, back central flap 27*b*, and back central panel 41*b*. As shown in FIG. 2, the handle openings 111*a*, 111*b*, 125*a*, 125*b* can be generally aligned with the respective handle flaps 101*a*, 101*b*, 115*a*, 115*b* and the respective openings 105*a*, 105*b*, 119*a*, 119*b* when the respective side reinforcing panels 75*a*, 75*b*, 77*a*, 77*b* overlap the respective side panels 17*a*, 17*b*, 19*a*, 19*b*.

Figure 3:
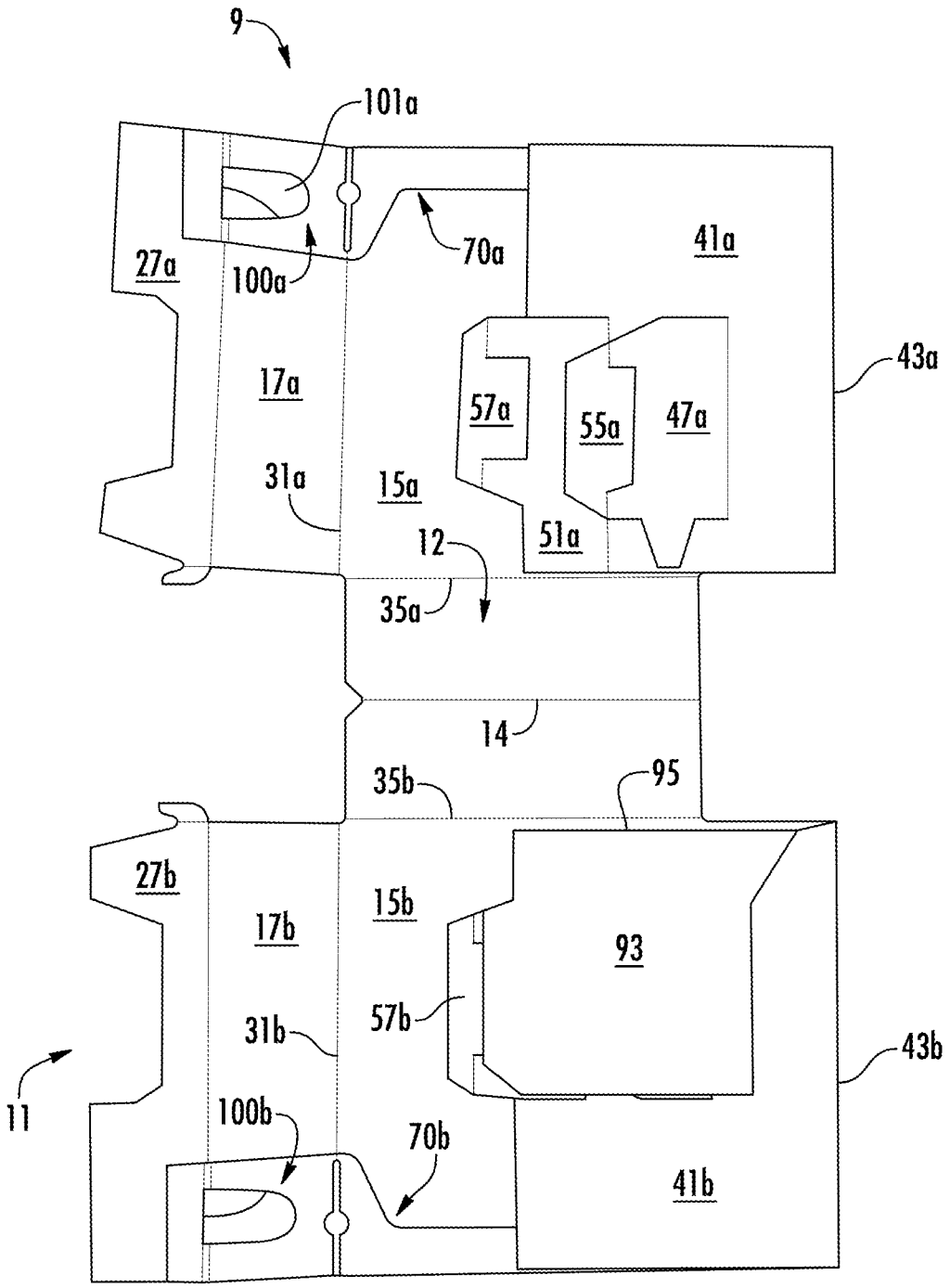

As shown in FIG. 3, the front and back central panels 41*a*, 41*b* can be folded about respective fold lines 43*a*, 43*b* so that the central panels are generally in face-to-face relationship with portions of the respective second side panels 19*a*, 19*b* and the respective front and back panels 15*a*, 15*b*. Additionally, after folding along the fold lines 43*a*, 43*b*, the central reinforcing panel 81*a* generally can overlap the front reinforcing panel 73*a* and the side reinforcing panel 77*a*, and the central reinforcing panel 81*b* generally can overlap the back reinforcing panel 73*b* and the side reinforcing panel 77*b*. Glue or other adhesive can be selectively applied to the blank 3 to adhesively connect the attachment flaps 55*a*, 57*a* to the front panel 15*a* and to adhesively connect the attachment flaps 55*b*, 57*b* to the back panel 15*b*. As shown in FIG. 3, the intermediate panel 93 can be folded along the fold line 95, away from the front central panel 41*a* and at least partially in face-to-face contact with the back central panel 41*b* and the divider flaps 47*b*, 51*b*. In one embodiment, the intermediate panel 93 can be at least partially glued to the back central panel 41*b*.

Figure 4:
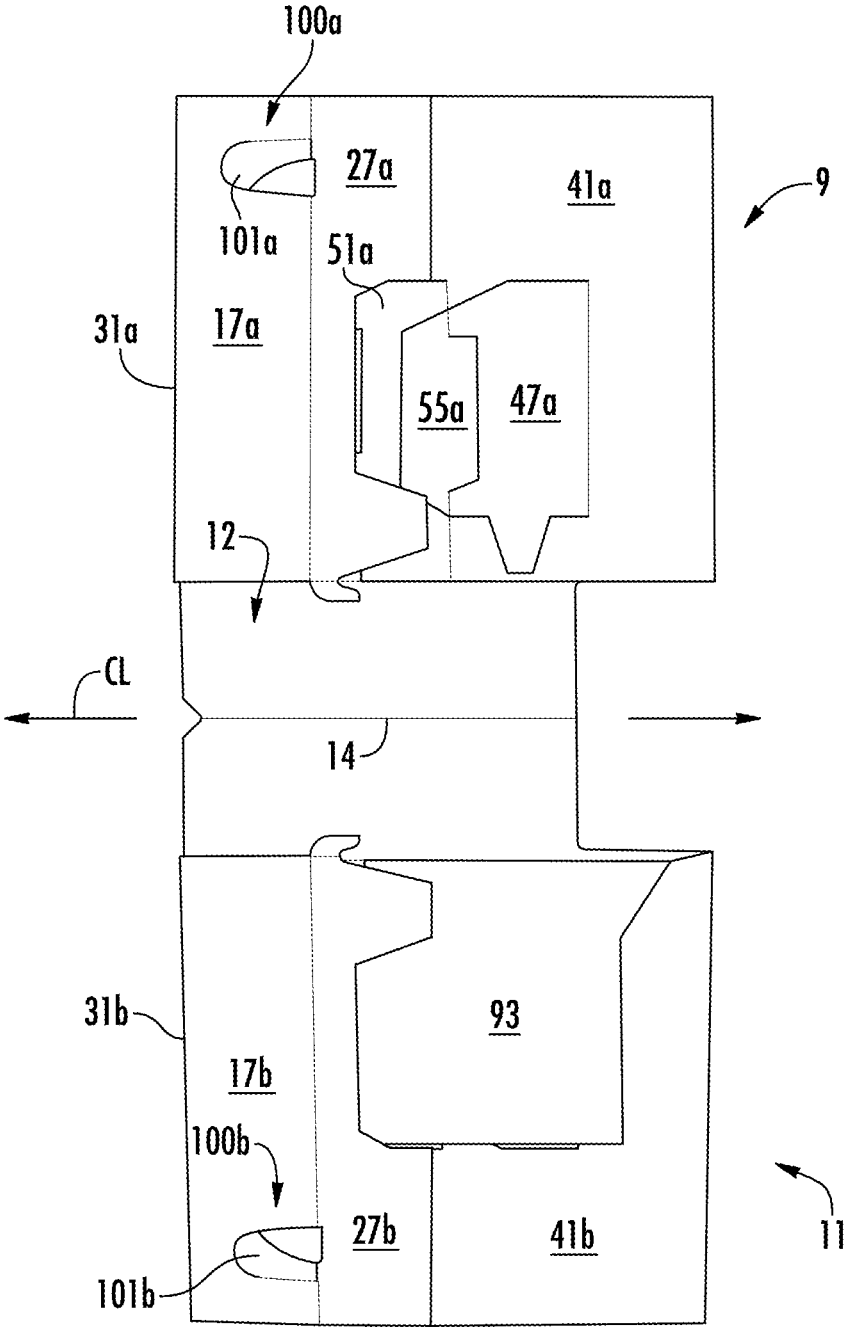

As shown in FIG. 4, the first side panels 17*a*, 17*b* can be folded about respective fold lines 31*a*, 31*b* so that the first side panels 17*a*, 17*b* and central flaps 27*a*, 27*b* generally overlap portions of the respective front panel 15*a*, back panel 15*b*, front central panel 41*a*, and back central panel 41*b*. In one embodiment, the central flaps 27*a*, 27*b* generally are disposed in face-to-face contact with portions of the respective front and back central panels 41*a*, 41*b* after folding along the fold lines 31*a*, 31*b*. Additionally, after folding along fold lines 31*a*, 31*b*, the side reinforcing panel 75*a* and the central reinforcing panel 79*a* generally can overlap the front reinforcing panel 73*a*, and the side reinforcing panel 75*b* and the central reinforcing panel 79*b* generally can overlap the back reinforcing panel 73*b* in the view shown in FIG. 4. Portions of the front central flap 27*a* can be selectively glued to portions of the front central panel 41*a*, and portions of the back central flap 27*b* can be selectively glued to portions of the back central panel 41*b*. For example, in one embodiment, glue could be applied to the central flaps 27*a*, 27*b* and the central panels 41*a*, 41*b* before and/or after folding portions of the blank 3.

Figure 5:
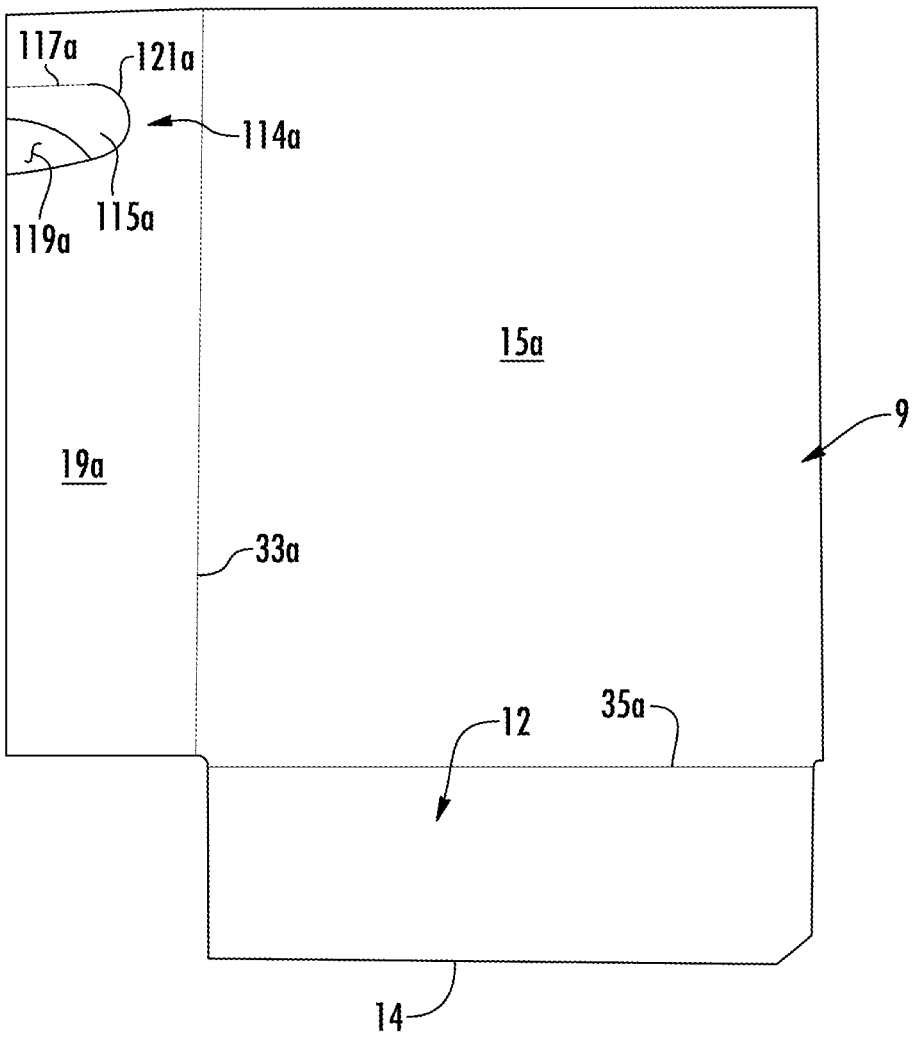
FIG. 5 is a plan view of the carrier formed from the blank of FIG. 1 in a flattened configuration.

In the illustrated embodiment, the partially assembled blank 3 of FIG. 4 can be folded about the lateral centerline CL (i.e., the intermediate fold line 14 in the bottom panel 12) so that the front portion 9 generally overlaps the back portion 11 (FIG. 5). As shown in FIG. 5, folding along the intermediate fold line 14 can position portions of the bottom panel 12 on either side of the intermediate fold line 14 generally in overlapping relationship. Portions of the front central panel 41*a* and the front central flap 27*a* can be selectively glued to portions of the respective back central panel 41*b* and back central flap 27*b* and/or the intermediate panel 93 to generally form a central wall or bulkhead 130 (FIGS. 6-8) between the front portion 9 and the back portion 11. In one embodiment, glue could be applied to the central flaps 27*a*, 27*b* and the central panels 41*a*, 41*b* before and/or after folding portions of the blank 3. In one embodiment, the carrier is in a flattened configuration as shown in FIG. 5.

Figure 6:
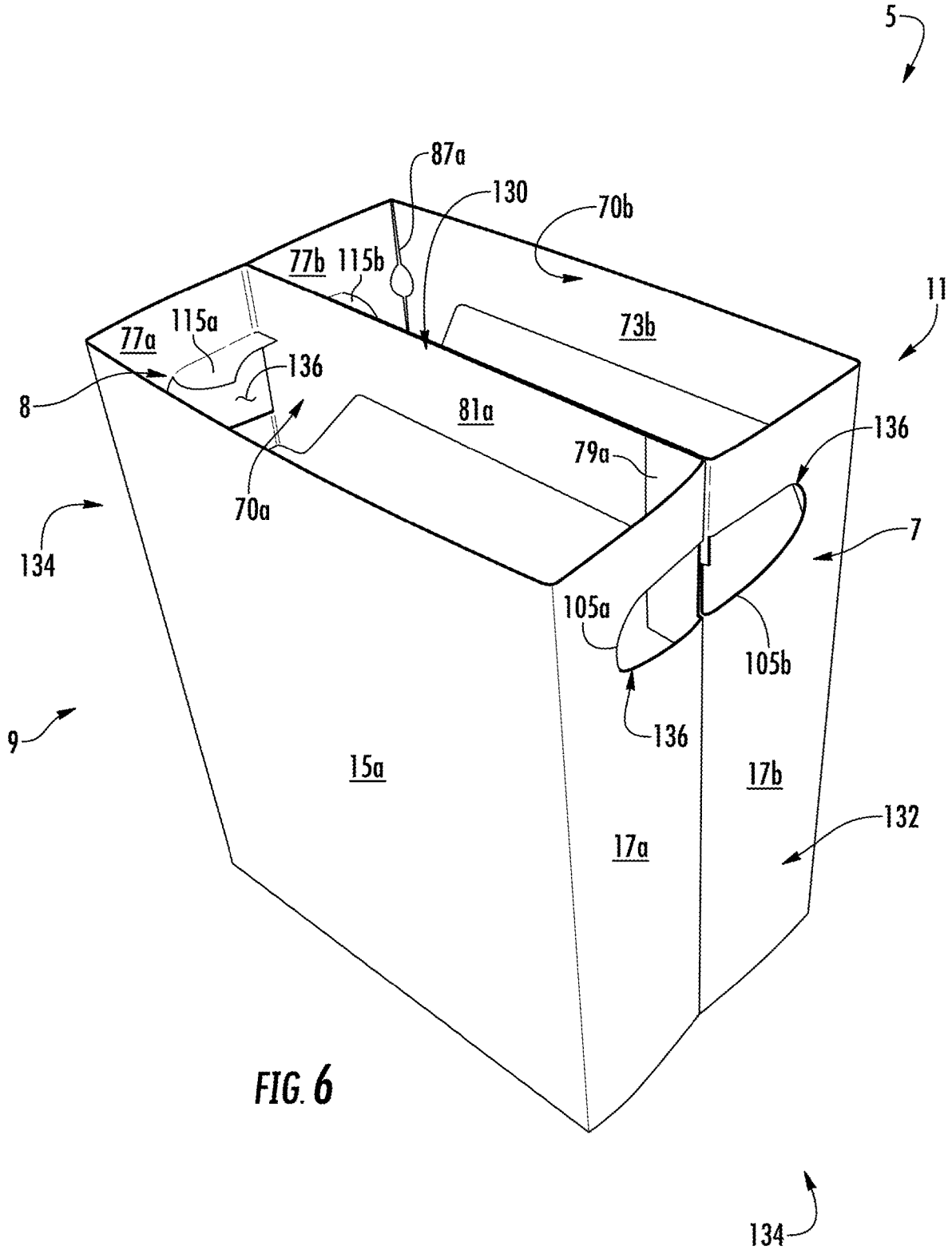
FIG. 6 is an exterior perspective view of the assembled carrier according to the exemplary embodiment of the disclosure.
Figure 7:
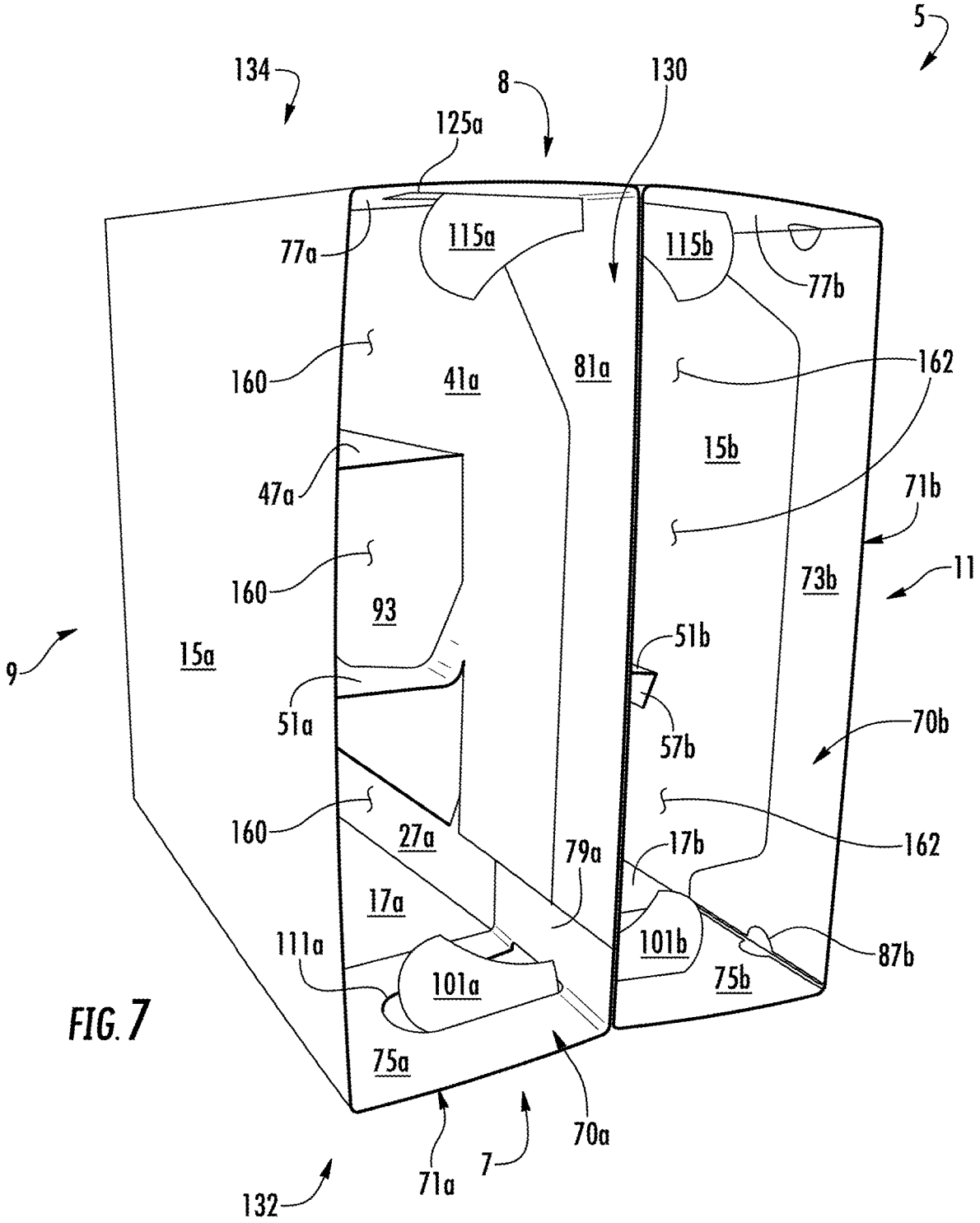
FIG. 7 is a top perspective view of the carrier of FIG. 6.
Figure 8:
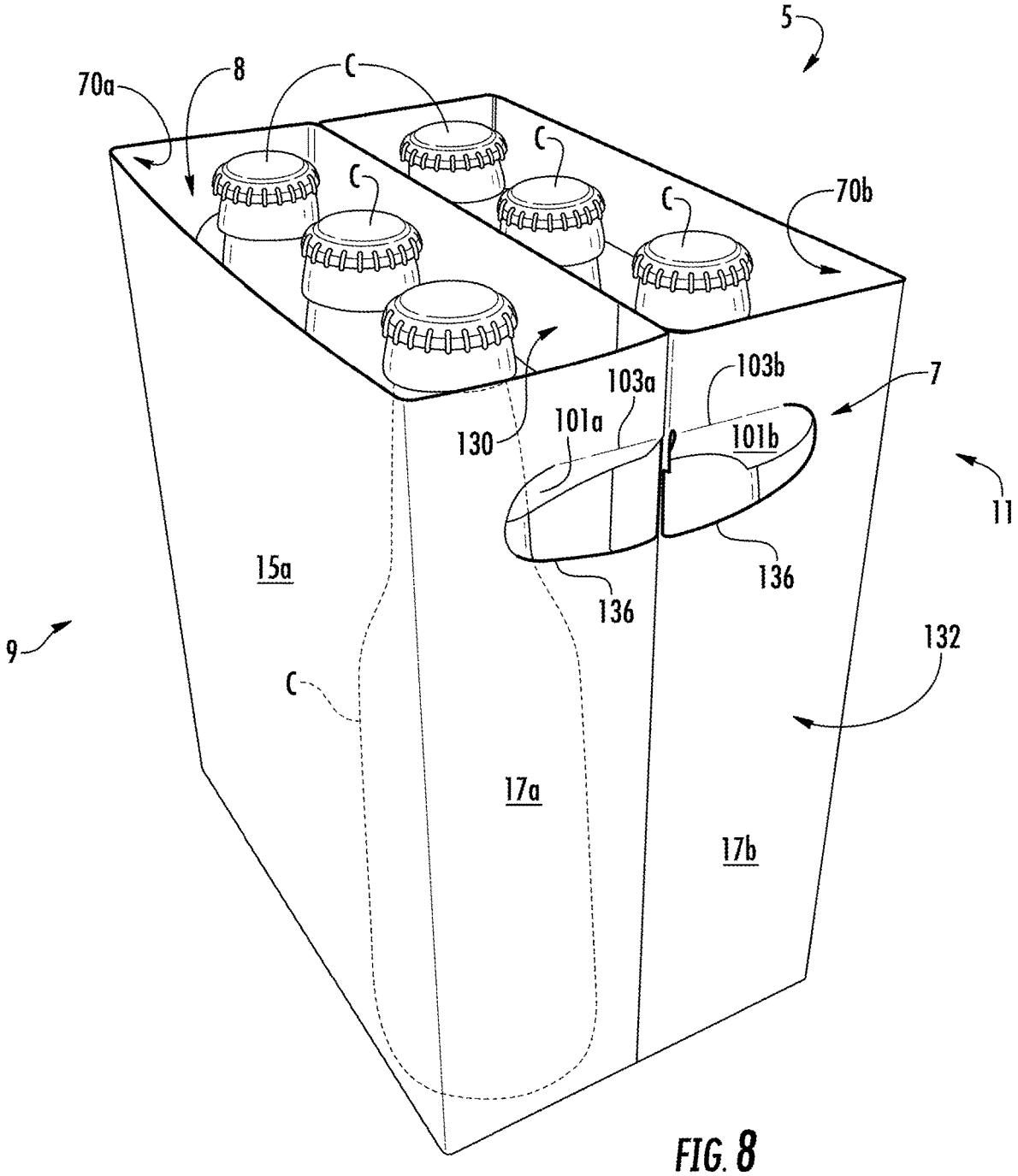
FIG. 8 is an exterior perspective view of a package including the assembled carrier of FIG. 6 with containers received therein.

The flattened carrier of FIG. 5 can be further assembled into the erected carrier 5, as shown in FIGS. 6-8, by positioning the first side panels 17*a*, 17*b* and second side panels 19*a*, 19*b* to be in a generally spaced-apart, parallel planar relationship, and positioning the front panel 15*a* and back panel 15*b* to be in a generally spaced-apart, parallel planar relationship. Such movement of the side panels 17*a*, 17*b*, 19*a*, 19*b* and front and back panels 15*a*, 15*b*, causes the divider flaps 47*a*, 51*a* in the front portion 9 of the carrier 5 to be positioned generally perpendicular to the central panel 41*a* and the front panel 15*a*, thereby dividing the front portion 9 into three container-receiving spaces 160 (FIG. 7). Similarly, the back portion 11 of the carrier is divided into three container-receiving spaces 162 by the divider flaps 47*b*, 51*b* (FIG. 7). The separating of the front and back panels 15*a*, 15*b* further pulls the bottom panel 12 flat across the bottom of the carrier 5 (e.g., folding along lateral fold lines 35*a*, 35*b*, 14) so that the bulkhead 130 is adjacent the bottom panel 12 between the front portion 9 and the back portion 11. Two hooks 13*a*, 13*b* disposed at the bottoms of the respective central flaps 27*a*, 27*b* can engage a notch 28 in the bottom panel 12 for supporting the bottom panel and/or helping to retain the bottom panel 12 in the erected configuration. In one exemplary embodiment, the flattened carrier of FIG. 5 can be opened into the erected configuration manually or by an automated system configured for opening fully enclosed-style carton. Alternatively, any suitable opening method could be used. The carrier 5 could be alternatively erected, formed, and/or arranged without departing from the present disclosure.

As shown in FIGS. 6-8, the side panels 17*a*, 17*b* can cooperate to form a first side 132 of the carrier 5, and the side panels 19*a*, 19*b* can cooperate to form a second side 134 of the carrier 5. In the illustrated embodiment, when the side panels 17*a*, 17*b* are generally aligned, the handle 7 is formed in the first side 132 with the handle features 100*a*, 100*b* generally side-by-side on either side of the bulkhead 130. Similarly, when the side panels 19*a*, 19*b* are generally aligned, the handle 8 is formed in the second side 134 with the handle features 114*a*, 114*b* generally side-by-side on either side of the bulkhead 130.

In one embodiment, containers C (FIG. 8) can be loaded into the respective container-receiving spaces 160, 162 (e.g., by loading the containers through the open top of the carrier 5). The containers C generally can be supported on the bottom panel 12.

One or both of the handles 7, 8 can be actuated for carrying the carrier 5 by, for example, folding the respective handle panels 101*a*, 101*b*, 115*a*, 115*b* along the respective fold lines 103*a*, 103*b*, 117*a*, 117*b* and through the aligned handle openings 111*a*, 111*b*, 125*a*, 125*b* to form handle openings 136 on either side of the bulkhead 130 at either end 132, 134 (e.g., FIGS. 6 and 7). A user's fingers can be inserted into the openings 136 on either side of the bulkhead 130 to grasp each end of the carrier at the handles 7, 8 for lifting, holding, carrying, etc. the carrier 5. For example, the user's fingers generally can straddle the bulkhead 130, which can help distribute the stresses on the carrier 5 due to carrying the carrier.

In the illustrated embodiment, the reinforcing structures 70*a*, 70*b* can reinforce the handles 7, 8 at the ends 132, 134 of the carrier 5 and generally can reinforcing the top portion of the carrier 5.

In the illustrated embodiment the carrier 5 can have a generally rectangular configuration (e.g., generally parallelpipedal in shape) with an open top so that the containers C (FIG. 8) can be drop-loaded into the carrier. Alternatively, the carrier 5 could be loaded by positioning the carrier over containers C and moving the carrier relative to the containers. In a further alternative, the carrier 5 could have alternative shapes and/or sizes and/or could have an at least partially closed top. For example, the front and back portions 9, 11 generally could be shorter so that portions of the containers C extend through the top of the carrier. The handles 7, 8 and the carrier 5 can be alternatively erected, formed, and/or arranged without departing from the present disclosure.

The exemplary carrier embodiment discussed above accommodates six containers C arranged in two rows, but the present disclosure is not limited to these numbers. As one example, additional containers may be accommodated by increasing the size of the blank 3 and forming additional container-receiving spaces therein. Also, the carrier 5 could have less than six container-receiving spaces.

The panels, flaps, and dividers shown and described in conjunction with the blank 3 and the carrier 5 are included by way of example. The handles 7, 8, the reinforcing structures 70*a*, 70*b*, and/or other features of the disclosure can alternatively be associated with any basket-style carrier or other carton having any divider or panel configuration.

In general, the blank may be constructed from paperboard having a caliper so that it is heavier and more rigid than ordinary paper. The blank can also be constructed of other materials, such as cardboard, or any other material having properties suitable for enabling the carrier or carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels extending at least partially around an interior of the carrier, the plurality of panels comprising at least a front panel and a side panel;

a central panel at least partially dividing the interior of the carrier into a front portion and a back portion, the side panel extending at least partially between the front panel and the central panel;

a handle comprising a handle feature extending in at least the side panel; and a reinforcing structure, the reinforcing structure at least partially overlapping at least one panel of the plurality of panels, the reinforcing structure comprises a front reinforcing panel foldably connected to a top marginal portion of the front panel and positioned in at least partial face-to-face contact with a top portion of the top panel, a side reinforcing panel foldably connected to a top marginal portion of the side panel and positioned in at least partial face-to-face contact with a top portion of the side panel, and a central reinforcing panel foldably connected to a top marginal portion of the central panel and positioned in at least partial face-to-face contact with a top portion of the central panel, such that the reinforcing structure reinforces a top portion of the carrier.

2. The carrier of claim 1, wherein the handle feature comprises a handle opening extending in the side panel.

3. The carrier of claim 1, wherein the handle feature comprises a handle flap foldably connected to the side panel.

4. The carrier of claim 3, wherein the side panel is foldably connected to the central panel along a first fold line, the handle flap is foldably connected to the side panel along a second fold line, and the second fold line extends from the first fold line.

5. The carrier of claim 4, wherein the handle further comprises a handle opening extending in the side panel adjacent the central panel and the handle flap.

6. The carrier of claim 1, further comprising a central flap being at least partially overlapped with the central panel, wherein the side panel is foldably connected to the front panel and the central flap.

7. The carrier of claim 1, wherein the side panel is foldably connected to the central panel and to the front panel.

8. The carrier of claim 7, wherein the side panel is a first side panel, the plurality of panels further comprises a second side panel foldably connected to the front panel, the second side panel is foldably connected to a central flap, and the central flap is at least partially overlapped with the central panel.

9. The carrier of claim 8, wherein the handle is a first handle and the handle feature is a first handle feature, the carrier further comprising a second handle comprising a second handle feature extending in at least the second side panel.

10. The carrier of claim 9, wherein the first handle feature comprises a first handle opening in the first side panel, and the second handle feature comprises a second handle opening in the second side panel.

11. The carrier of claim 9, wherein the first handle feature comprises a first handle flap foldably connected to the first side panel, and the second handle feature comprises a second handle flap foldably connected to the second side panel.

12. The carrier of claim 8, wherein the side reinforcing panel is a first side reinforcing panel at least partially overlapping the first side panel, and the reinforcing structure further comprises a second side reinforcing panel at least partially overlapping the second side panel.

13. The carrier of claim 12, wherein the handle is a first handle comprising a first handle opening in the first side panel and a second handle opening in the first side reinforcing panel, the second handle opening being generally aligned with the first handle opening, the carrier further comprising a second handle comprising a third handle opening in the second side panel and a fourth handle opening in the second side reinforcing panel, the fourth handle opening being generally aligned with the third handle opening.

14. The carrier of claim 1, wherein front panel is foldably connected to a bottom panel, the plurality of panels further comprises a back panel, and the back panel is foldably connected to the bottom panel.

15. The carrier of claim 1, wherein the side panel is a front side panel, and the plurality of panels further comprises at least a back panel and a back side panel.

16. The carrier of claim 15, wherein the handle feature is a first handle feature, and the handle further comprises a second handle feature extending the back side panel.

17. The carrier of claim 16, wherein the first handle feature comprises a first handle opening in the front side panel, and the second handle feature comprises a second handle opening in the back side panel.

18. The carrier of claim 17, wherein the reinforcing structure is a front reinforcing structure and the carrier further comprises a back reinforcing structure, the side reinforcing panel is a front side reinforcing panel of the front reinforcing structure and at least partially overlaps the front side panel, the back reinforcing structure comprising at least a back side reinforcing panel at least partially overlapping the back side panel, and the handle further comprises a third handle opening in the front side reinforcing panel and a fourth handle opening in the back side reinforcing panel, the third handle opening and the fourth handle opening being generally aligned with the respective first handle opening and second handle opening.

19. The carrier of claim 16, wherein the first handle feature comprises a first handle flap foldably connected to the front side panel, and the second handle feature comprises a second handle flap foldably connected to the back side panel.

20. The carrier of claim 1, wherein the side panel is foldably connected to the front panel and the central panel, and the side reinforcing panel is foldably connected to the front reinforcing panel and the central reinforcing panel.

21. The carrier of claim 1, wherein the reinforcing structure is foldably connected to the at least one panel.

22. The carrier of claim 1, wherein the handle further comprises a handle opening in the side reinforcing panel, and the handle opening is at least partially aligned with the handle feature in the side panel.

23. The carrier of claim 22, wherein the side reinforcing panel is foldably connected to the side panel.

24. The carrier of claim 1, further comprising a divider flap foldably connected to the central panel and extending from the central panel to the front panel, wherein the divider flap comprises an attachment flap engaging the front panel.

25. The carrier of claim 1, wherein at least one panel of the plurality of panels comprises a height, and the height is substantially equal to or greater than an article height of at least one article of the plurality of articles.

26. The carrier of claim 1, wherein at least one of the front reinforcing panel, the side reinforcing panel, and the central reinforcing panel is foldably connected to at least one of the respective top marginal portion of the front panel, the top marginal portion of the side panel, and the top marginal portion of the central panel at a respective longitudinal fold line.

27. A blank for forming a carrier for holding a plurality of containers, the blank comprising:

a plurality of panels comprising at least a front panel and a side panel;

a central panel for at least partially dividing the carrier formed from the blank into a front portion and a back portion, the side panel being for extending at least partially between the front panel and the central panel when the carrier is formed from the blank;

a handle comprising a handle feature extending in at least the side panel; and a reinforcing structure for reinforcing a top portion of the carrier formed from the blank, the reinforcing structure being for at least partially overlapping at least one panel of the plurality of panels in the carrier formed from the blank, the reinforcing structure comprises a front reinforcing panel foldably connected to a top marginal portion of the front panel and for being positioned in at least partial face-to-face contact with a top portion of the front panel in the carrier formed from the blank, a side reinforcing panel foldably connected to a top marginal portion of the side panel and for being positioned in at least partial face-to-face contact with a top portion of the side panel in the carrier formed from the blank, and a central reinforcing panel foldably connected to a top marginal portion of the side panel and for being positioned in at least partial face-to-face contact with a top portion of the central panel in the carrier formed from the blank.

28. The blank of claim 27, wherein the handle feature comprises a handle opening extending in the side panel.

29. The blank of claim 27, wherein the handle feature comprises a handle flap foldably connected to the side panel.

30. The blank of claim 27, wherein the side panel is foldably connected to the central panel and to the front panel.

31. The blank of claim 30, wherein the side panel is a first side panel, the plurality of panels further comprises a second side panel foldably connected to the front panel, the second side panel is foldably connected to a central flap, and the central flap is for being at least partially overlapped with the central panel when the carrier is formed from the blank.

32. The blank of claim 31, wherein the handle is a first handle and the handle feature is a first handle feature, the carrier further comprising a second handle comprising a second handle feature extending in at least the second side panel.

33. The blank of claim 27, wherein front panel is foldably connected to a bottom panel, the plurality of panels further comprises a back panel, and the back panel is foldably connected to the bottom panel.

34. The blank of claim 27, wherein the side panel is a front side panel, and the plurality of panels further comprises at least a back panel and a back side panel.

35. The blank of claim 34, wherein the handle feature is a first handle feature, and the handle further comprises a second handle feature extending the back side panel.

36. The blank of claim 27, wherein the side panel is foldably connected to the front panel and the central panel, and the side reinforcing panel is foldably connected to the front reinforcing panel and the central reinforcing panel.

37. The blank of claim 27, wherein the reinforcing structure is foldably connected to the at least one panel.

38. The blank of claim 27, wherein the handle further comprises a handle opening in the side reinforcing panel, and the handle opening is for being at least partially aligned with the handle feature in the side panel when the carrier is formed from the blank.

39. The blank of claim 38, wherein the side reinforcing panel is foldably connected to the side panel.

40. The blank of claim 27, further comprising a divider flap foldably connected to the central panel and an attachment flap foldably connected to the divider flap, wherein the divider flap is for extending from the central panel to the front panel and the attachment flap is for engaging the front panel when the carrier is formed from the blank.

41. A method of forming a carrier for holding a plurality of containers, the method comprising:

obtaining a blank comprising a plurality of panels, a central panel, a handle feature, and a reinforcing structure, the plurality of panels comprising at least a front panel and a side panel, the handle feature extending in at least the side panel, and the reinforcing structure comprising a front reinforcing panel foldably connected to a top marginal portion of the front panel, a side reinforcing panel foldably connected to a top marginal portion of the side panel, and a central reinforcing panel foldably connected to a top marginal portion of the central panel; and forming an interior of the carrier by positioning the panels of the plurality of panels to extend at least partially around the interior of the carrier, positioning the central panel to at least partially divide the interior of the carrier into a front portion and a back portion, the side panel extending at least partially between the front panel and the central panel;

reinforcing a top portion of the carrier by positioning the front reinforcing panel in at least partial face-to-face contact with a top portion of the front panel, positioning the side reinforcing panel in at least partial face-to-face contact with a top portion of the side panel to at least partially overlap the side panel, and positioning the central reinforcing panel in at least partial face-to-face contact with a top portion of the central panel;

wherein the handle feature at least partially forms a handle in the carrier.

42. The method of claim 41, wherein the side panel is a first side panel, the handle is a first handle, and the handle feature is a first handle feature, the plurality of panels further comprises a second side panel, the positioning the panels of the plurality of panels comprising disposing the second side panel generally opposite to the first side panel, and the blank further comprises a second handle comprising a second handle feature extending in the second side panel.

43. The method of claim 41, wherein the front panel is foldably connected to a bottom panel, the plurality of panels further comprises a back panel, the back panel is foldably connected to the bottom panel, and the method further comprises positioning the front panel and the back panel respectively opposite to the central panel so that the bottom panel extends from the front panel to the back panel and the central panel extends adjacent the bottom panel.

44. The method of claim 41, wherein the side panel is a front side panel and the handle feature is a first handle feature, the plurality of panels further comprises a back panel and a back side panel, the back side panel extends at least partially between the central panel and the back panel, and the handle further comprises a second handle feature extending in the back side panel.

45. The method of claim 41, wherein the reinforcing structure is foldably connected to the at least one panel.

46. The method of claim 41, wherein the handle further comprises a handle opening extending in the side reinforcing panel, and positioning the side reinforcing panel comprises disposing the handle opening to be generally aligned with the handle feature.

* * * * *